US008551131B2

(12) United States Patent
Song

(10) Patent No.: US 8,551,131 B2
(45) Date of Patent: Oct. 8, 2013

(54) METHOD OF PERFORMING SOOJICHIM ACUPUNCTURE USING BODYCOPY

(76) Inventor: Mi-Seon Song, Kyeongki-Do (KR)

( * ) Notice: Subject to any disclaimer, the term of this patent is extended or adjusted under 35 U.S.C. 154(b) by 0 days.

(21) Appl. No.: 13/220,118

(22) Filed: Aug. 29, 2011

(65) Prior Publication Data

US 2011/0313441 A1 Dec. 22, 2011

Related U.S. Application Data

(63) Continuation-in-part of application No. 10/511,076, filed as application No. PCT/KR03/00719 on Apr. 10, 2003, now abandoned.

(30) Foreign Application Priority Data

Apr. 10, 2002 (KR) ..... 10-2002-0019485

(51) Int. Cl.
*A61H 39/00* (2006.01)

(52) U.S. Cl.
USPC ..... 606/189; 601/1

(58) Field of Classification Search
USPC ..... 606/189, 204; 128/907; 601/1
See application file for complete search history.

(56) References Cited

U.S. PATENT DOCUMENTS

| | | | | |
|---|---|---|---|---|
| 4,073,296 | A * | 2/1978 | McCall | 606/204 |
| 4,098,277 | A | 7/1978 | Mendell | |
| 4,233,966 | A * | 11/1980 | Takahashi | 601/134 |
| 5,405,357 | A | 4/1995 | Rowe-Lanzisera et al. | |
| 6,030,408 | A | 2/2000 | Kramer | |
| 6,261,306 | B1 * | 7/2001 | Kramer | 606/204 |

FOREIGN PATENT DOCUMENTS

| | | | |
|---|---|---|---|
| KR | 1998-052487 | A | 9/1998 |
| KR | 100237391 | B1 | 10/1999 |
| KR | 2001-0106879 | A | 12/2001 |
| KR | 10-0444063 | B1 | 2/2004 |

OTHER PUBLICATIONS

USPTO NFOA mailed Oct. 18, 2005 in connection with U.S. Appl. No. 10/511,076.
USPTO FOA mailed Oct. 22, 2010 in connection with U.S. Appl. No. 10/511,076.
USPTO NFOA mailed Feb. 10, 2011 in connection with U.S. Appl. No. 10/511,076.
USPTO FOA mailed May 31, 2011 in connection with U.S. Appl. No. 10/511,076.

* cited by examiner

*Primary Examiner* — Kathleen Holwerda
*Assistant Examiner* — Sarah W Aleman
(74) *Attorney, Agent, or Firm* — Ladas & Parry LLP

(57) ABSTRACT

The present invention disclosed a method of performing Soojichim acupuncture on oneself using a copy of the person's body. The method includes: making an instantaneous molding of any one of hand and foot of the person requiring Soojichim acupuncture; forming a copy of the body on the basis of the instantaneous molding; marking an acupoint location and a reference point on the body copy; drilling a hole into the marked acupoint location on the body copy; attaching the body copy based on the marked reference point closely onto the body of the person requiring Soojichim acupuncture; marking the acupoint location at a skin of the person requiring Soojichim acupuncture through the drilled hole of the body copy; baring the body copy from the person requiring Soojichim acupuncture that the acupoint location is marked at the skin thereon; and performing Soojichim acupuncture through the drilled hole at the marked acupoint location of the body copy by the person.

2 Claims, 3 Drawing Sheets

METHOD OF PERFORMING SOOJICHIM ACUPUNCTURE USING BODYCOPY

TECHNICAL FIELD

The present invention relates in general to a method enabling a person requiring Soojichim acupuncture to perform it by oneself using a copy of the person's body. More particularly, the present invention relates to a method by which a person who has insufficient professional knowledge on acupoint locations and Soojichim acupuncture therapy and also has a difficulty to call on a specialist in Chinese medicine due to the inconvenience of moving can perform Soojichim acupuncture by oneself at home using a copy of the person's body.

BACKGROUND ART

Unlike general drug therapy, Soojichim acupuncture, which is also called Koryo hand acupuncture or Korean hand acupuncture, has no side effects upon its application and does not cause sequelae or tolerance even upon long-term application. In addition, it is conducted in an easy manner and has excellent effects. For these reasons, it is advantageous in that it can be widely applied to general people.

On the other hand, in order to perform Soojichim acupuncture, there is required through knowledge of the acupoint locations effective for a disease on which Soojichim acupuncture can be applied. The acupoint locations significantly vary depending on a disease and are complicated, and thus, Soojichim acupuncture has disadvantage in that only a person who had had learned professional education on Soojichim acupuncture can easily perform Soojichim acupuncture. For this reason, Soojichim acupuncture is performed by only a specialist in Soojichim acupuncture of Chinese herbal medicine in a limited manner without being propagated to general people due to problems of time and cost required for the professional education.

Meanwhile, in attempts to solve these problems, Korean Patent Application No. 1996-71491 discloses an apparatus for guiding Soojichim acupuncture needles to acupoint locations, Korean Patent Application No. 1997-34508 discloses a system for supporting recognition of acupoint locations and a method of performing Soojichim acupuncture using the same, Korean Patent Application No. 2002-27889 discloses a human body diagram, the classification of diseases, and a method of performing and learning Soojichim acupuncture using the information on hand meridians, and Korean Patent Application No. 2002-25576 discloses an apparatus for indication acupoint locations. However, in these prior arts, the acupoint locations are identified by Internet, or recognized by an expensive system or apparatus, which is used in a complex manner.

Thus, these prior arts have problems in that they are unsuitable for use in an old and feeble person among general people requiring Soojichim acupuncture or in an area having a difficulty to use Internet, and also uneconomical.

DISCLOSURE OF THE INVENTION

Accordingly, the present invention has been made to solve the above mentioned problems occurring in the prior art, and an object of the present invention is to provide a method enabling a person requiring Soojichim acupuncture for the health maintenance and treatment to easily perform it by oneself at home by forming a copy of the person's body, and marking acupoint locations on the body copy by force of a specialist in Chinese medicine, and then performing Soojichim acupuncture according to the marked acupoint locations.

To achieve the above object, the present invention provides a method enabling a person requiring Soojichim acupuncture to perform Soojichim acupuncture on oneself using a copy of the person's body, which comprises the steps of: making an instantaneous molding of any one of hand and foot of the person requiring Soojichim acupuncture; forming a copy of the body on the basis of the instantaneous molding; marking an acupoint location and a reference point on the body copy; drilling a hole into the marked acupoint location on the body copy; attaching the body copy based on the marked reference point closely onto the body of the person requiring Soojichim acupuncture; marking the acupoint location at a skin of the person requiring Soojichim acupuncture through the drilled hole of the body copy; baring the body copy from the person requiring Soojichim acupuncture that the acupoint location is marked at the skin thereon; and performing Soojichim acupuncture through the drilled hole at the marked acupoint location of the body copy by the person requiring Soojichim acupuncture, wherein the step of performing Soojichim acupuncture is performed with any one of an acupuncture stick or needle.

BRIEF DESCRIPTION OF THE DRAWINGS

A preferred embodiment of the present invention will now be described in detail with reference to the accompanying drawings, in which.

BEST MODE FOR CARRYING OUT THE INVENTION

Figure 1:
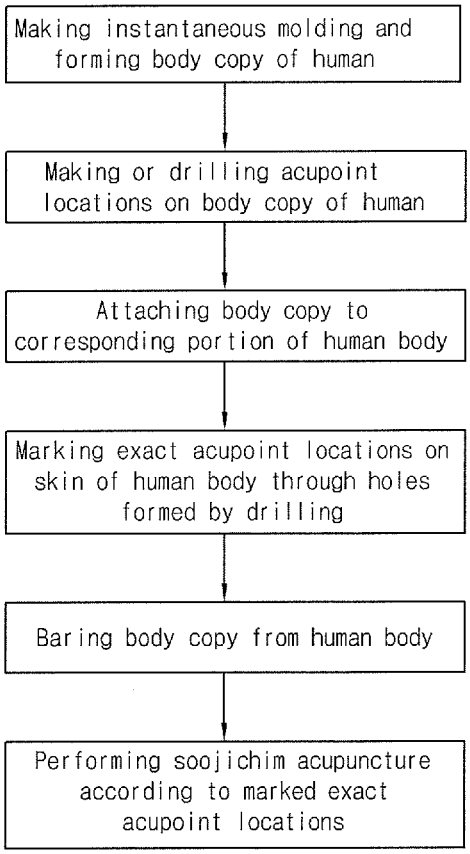
FIG. 1 is a flowchart illustrating a method of performing Soojichim acupuncture by oneself using a body copy according to the present invention.
Figure 2A:
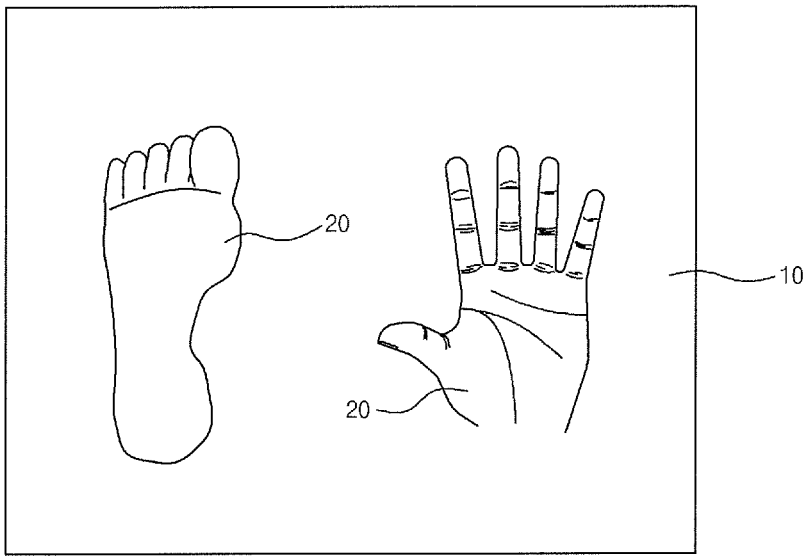
FIGS. 2*a* and 2*b* schematically show a process of forming a copy of the human body according to the present invention.
Figure 2B:
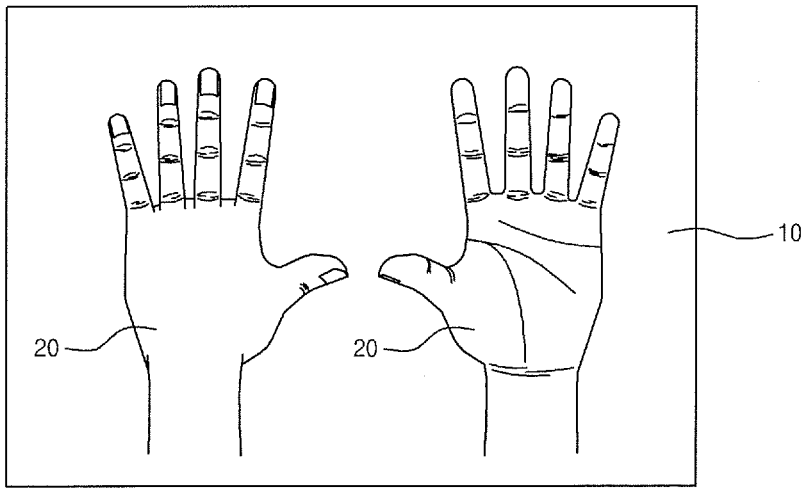
Figure 3:
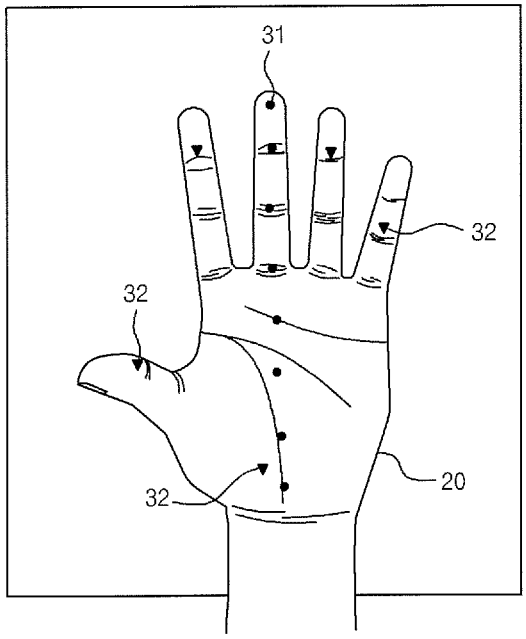
FIG. 3 shows a copy of the human body according to the present invention, on which acupoint locations were marked.

FIG. 1 is a flowchart illustrating a method of performing Soojichim acupuncture by oneself using a body copy according to the present invention; FIGS. 2*a* and 2*b* schematically show a process of forming a copy of the human body according to the present invention; and FIG. 3 shows a copy of the human body according to the present invention, on which acupoint locations were marked.

First, as shown in FIG. 2*a*, an instantaneous molding 10 is made. Next, as shown in FIG. 2*b*, a copy body 20 of the human is formed using the instantaneous molding 10.

In this case, the body copy 20 is formed in the same manner as a body copy of the human that is mainly used in body copy shops or medical offices, which are currently managed in various areas. In other word, as shown in FIG. 2*a*, the instantaneous molding 10 is made by a conventional method allowing precise expression of fingerprints or pores of any desired body portions, such as hand, foot, ear and the like, and then, as shown in FIG. 2*b*, the body copy 20 is formed using the instantaneous molding 10.

The instantaneous molding 10 of the body is easily made at home by means of an instantaneous molding kit. Alternatively, it is made in the body copy shop in an inexpensive, easy and rapid manner. Generally, the instantaneous molding 10 is made from vegetable silicon, synthetic clay, synthetic resin or the like.

Such an instantaneous molding 10 can precisely express the body portion, and also if once it is made, it is not deformed so that it can be stored for a long period of time. The instantaneous molding 10 is preferably formed on the basis of the body part (for example, and, foot, ear or the like) which needs to subject Soojichim acupuncture of the person requiring Soojichim acupuncture. Then, the instantaneous molding 10 is used for forming a copy of the body of the person requiring Soojichim acupuncture form the instantaneous molding 10. Thus, after the body copy which was formed on the basis of the instantaneous molding 10 is used in Soojichim acupuncture, the used body copy is re-used in subsequent Soojichim acupuncture. If the body copy gets damaged, there can be used a new body copy which is formed using the stored instantaneous molding 10.

The body copy of hand, foot, ear or the like formed as described above is sent to a specialist in Chinese medicine or Soojichim acupuncture. By virtue of the specialist or according to the identified acupoint locations by Internet or books known to those skilled in the art, acupoint locations effective for disease treatment are marked or drilled on the body copy in view of the age or physical conditions of a person requiring Soojichim acupuncture, and then holes are formed into the marked acupoint locations by drilling the marked acupoint locations on the body copy 20.

In addition to the acupoint locations 31, as shown in FIG. 3, reference points 32 are marked on the body copy 20 in order to prevent the marked acupoint locations 31 of the body copy from being deviated from the corresponding acupoint locations 31 of the body upon attachment of the body copy 20 to the body.

During safekeeping of the body copy 20 in the home, if health maintenance or treatment recommended by a medical specialist is required, Soojichim acupuncture is performed on the exact acupoint locations 31 using the body copy 20. Specifically, the body copy that holes are formed at the acupoint locations marked by a specialist is closely attached based on the marked reference points onto the body of the person requiring Soojichim acupuncture, and then an exact acupoint locations is marked on skin of the body part of the person requiring Soojichim acupuncture through the drilled holes of the body copy. Next, the body copy is barred from the person requiring Soojichim acupuncture, and then Soojichim acupuncture is performed by oneself the person requiring Soojichim acupuncture. For example, Soojichim acupuncture is performed in manner by pressing the marked exact acupoint locations on skin of the person requiring Soojichim acupuncture with any one of an acupressure stick or a needle.

As a result, a person requiring Soojichim acupuncture can perform Soojichim acupuncture on the exact acupoint locations 31 by oneself using the body copy 20 without calling on a specialist in Chinese medicine or Soojichim acupuncture. In particular, an old and feeble person or other patients having the difficulty of moving can receive Soojichim acupuncture from a family without calling on a dispensary of Chinese medicine.

In addition to Soojichim acupuncture, press moxibustion or press pellets, etc., may also be applied to the acupoint location 31 using the body copy 20.

INDUSTRIAL APPLICABILITY

As apparent from the foregoing, the present invention is advantageous in that it enables a person having no professional knowledge on the acupoint locations 31 to perform Soojichim acupuncture in a simple and easy manner, and particularly, it enable a person having difficulty of moving to perform Soojichim acupuncture on the exact locations 31 of acupoints at home without calling on a specialist Soojichim acupuncture.

In addition, the present invention is advantageous in that it does not require a special apparatus or system to recognize the acupoint locations 31, and also the produced instantaneous molding 10 can be stored for a long period of time, so that the present invention is highly economical.

Although specific embodiments of the present invention have been described for illustrative purposes, those skilled in the art will appreciate that various modifications, additions and substitutions are possible, without departing from the scope and the spirit of the invention as disclosed in the accompanying claims.

What is claimed is:

1. A method for performing Soojichim acupuncture on oneself using a copy of the person's body, which comprises the steps of:

making an instantaneous molding of any one of hand and foot of the person requiring Soojichim acupuncture;

forming a copy of the body on the basis of the instantaneous molding;

marking an acupoint location and a reference point on the body copy by a specialist in Chinese medicine or Soojichim acupuncture;

drilling a hole into the marked acupoint location on the body copy;

attaching the body copy based on the marked reference point closely onto the body of the person requiring Soojichim acupuncture;

marking the acupoint location at a skin of the person requiring Soojichim acupuncture through the drilled hole of the body copy;

removing the body copy from the skin of the person requiring Soojichim acupuncture that the acupoint location is marked at the skin thereon; and performing Soojichim acupuncture on oneself through the marked acupoint location at the skin thereon by the person requiring Soojichim acupuncture.

2. The method according to claim 1, wherein the step of performing Soojichim acupuncture is performed with any one of an acupuncture stick or needle.

* * * * *